United States Patent [19]

Abe et al.

[11] Patent Number: 4,622,759

[45] Date of Patent: Nov. 18, 1986

[54] CONTROL SYSTEM FOR CLOTHES DRYER

[75] Inventors: Syuzi Abe, Amagasaki; Shin'ichi Ito, Kobe, both of Japan

[73] Assignee: Matsushita Electric Industrial Co., Ltd., Kadoma, Japan

[21] Appl. No.: 764,783

[22] Filed: Aug. 12, 1985

[30] Foreign Application Priority Data

Aug. 18, 1984 [JP] Japan ..... 59-171964

[51] Int. Cl.[4] ..... F26B 21/10

[52] U.S. Cl. ..... 34/44; 34/48; 34/53

[58] Field of Search ..... 34/48, 54, 44, 53

[56] References Cited

U.S. PATENT DOCUMENTS 4,267,643 5/1981 Haried ..... 34/48

4,286,391 9/1981 Gerry ..... 34/48

4,412,389 11/1983 Kruger ..... 34/48

*Primary Examiner*—Larry I. Schwartz

*Attorney, Agent, or Firm*—Wenderoth, Lind & Ponack

[57] ABSTRACT

A control system for a clothes dryer comprises an exhaust temperature detector, a comparator for outputting a signal when either the exhaust temperature or the rate of change in exhaust temperature attains a value higher than a predetermined value, a first timer for counting the time elapsed from the start of operation up until the generation of the signal from the comparator, a calculator for determining the time, during which an electric power is subsequently supplied to a heater, in correspondence to the time counted by the first timer, a temperature adjustment capable of generating, when the exhaust temperature is higher than the predetermined value, an output signal necessary to cause a first control to interrupt the supply of the electric power to the heater, a second timer for counting the length of time determined by the calculator, and a second control operable in response to the output from the second timer for deenergizing both the heater and the motor.

7 Claims, 11 Drawing Figures

CONTROL SYSTEM FOR CLOTHES DRYER

BACKGROUND OF THE INVENTION

The present invention relates to a control system for a clothes dryer for household use.

In the prior art clothes dryer of a type wherein wet clothes are dried by the application of hot air while tumbled inside the rotating drum, it is usual to employ a mechanical timer for presetting an operating duration during which the dryer is operated according to the quantity or type of the clothes. The presetting of the mechanical timer requires the operator to have a knack or skill in the determination of the operating duration and, therefore, a difficulty has been encountered in the determination of an operating duration appropriate to a given quantity or type of clothes. It has also been often experienced that, if the operating duration is not properly set in the mechanical timer, the clothes are either excessively or insufficiently dried and/or some of the clothes are impaired. As a matter of course, the excessive drying brings about an additional problem in that unnecessarily increased amount of electric power is consumed.

A system wherein the surface resistance of the clothes being dried detected by the use of elecrodes to determine the extent to which they are dried is also well known in the art. This system is, however, disadvantageous in that, since the surface resistance varies with the type of clothes, an accurate detection of the dryness of the clothes is difficult to achieve. In view of this, this system has been improved to include an exhaust temperature sensor for detecting the temperature of exhaust air vented from the inside of the rotating drum and is so designed that, while the detection of the surface resistance is carried out by the use of the electrodes until the clothes are dried to a certain extent, the exhaust temperature sensor can be utilized to subsequently determined the time at which the drying operation is to be brought to a halt, in dependence on the rate of increase of the temperature of the exhaust air. Even this improved system has a problem in that, since two separate elements such as the exhaust temperature sensor and the electrodes are required, the structure tends to become complicated. Moreover, since a relatively high voltage is required to detect a high surface resistance by means of the electrodes, this often poses an additional problem associated with the safety factor.

SUMMARY OF THE INVENTION

The present invention is based on the finding of the existence of the correlationship between the dryness of the clothes and the exhaust temperature and has for its essential object to provide an improved control system for a clothes dryer which utilizes only one temperature sensitive element to accurately control the optimum dryness of the clothes regardless of the quantity and the type of such clothes.

To this end, the control system according to the present invention comprises an exhaust temperature detecting means for detecting the temperature of the exhaust air, a comparing means operable in response to an output from the exhaust temperature detecting means, a temperature adjusting means operable in response to the output from the exhaust temperature detecting means, a first timer means for counting the time elapsed from the time of start of the drying operation to the time of generation of a control signal from the comparing means, a calculating means for determining the length of time corresponding to the period during which the first counter means performs its counting operation, a second timer means for counting the length of time determined by the calculating means and for outputting a control signal when the counting of said length of time has completed, said second timer means being disabled to interrupt its counting operation during a period in which the temperature adjusting means generates a control signal, a first control means for deenergizing a heater in response to the control signal from the temperature adjusting means, and a second control means for deenergizing both the heater and a motor in response to the control signal from the second timer means.

BRIEF DESCRIPTION OF THE DRAWINGS

This and other objects and features of the present invention will become readily understood from the following description taken in conjuction with a preferred embodiment thereof with reference to the accompanying drawings, in which.

DETAILED DESCRIPTION OF THE EMBODIMENT

Figure 1:
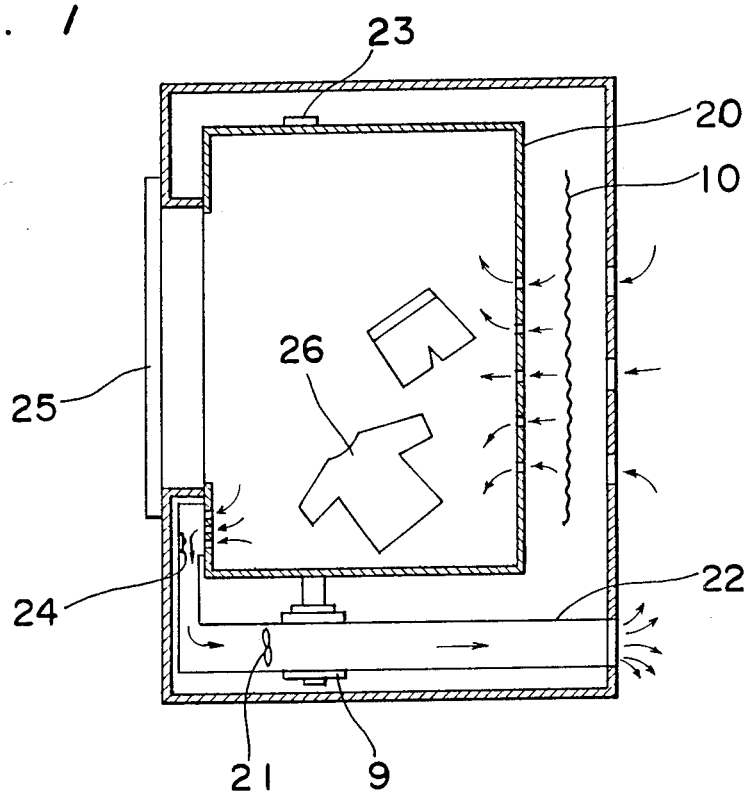
FIG. 1 is a schematic side sectional view of a clothes dryer.

Referring first to FIG. 1, a clothes dryer schematically shown therein comprises a rotary drum 20 rotatably supported within a cabinet and adapted to be driven by a motor 9 for both the drum 20 and a fan. The rotary drive of the motor 9 can be transmitted to the drum 20 by means of a generally endless belt 23 so that, during the rotation of the drum 20, clothes 26 to be dried accommodated within the drum 20 can be tumbled within the drum 20 while air heated by a heater 10 is introduced into the drum 20 to dry the clothes 26. Reference numeral 21 represents a fan operable to draw the air into the drum 20 through the heater 10 and then to exhaust or vent the hot air to the atmosphere through a duct 22 after the hot air has been utilized to dry the clothes 26. Reference numeral 24 represents a thermistor for detecting the exhaust temperature, that is, the temperature of the hot air so exhausted. Reference numeral 25 represents a door hinged to the cabinet for selectively closing and opening an entry opening through which the clothes 26 to be dried are put into the drum 20.

Figure 2:
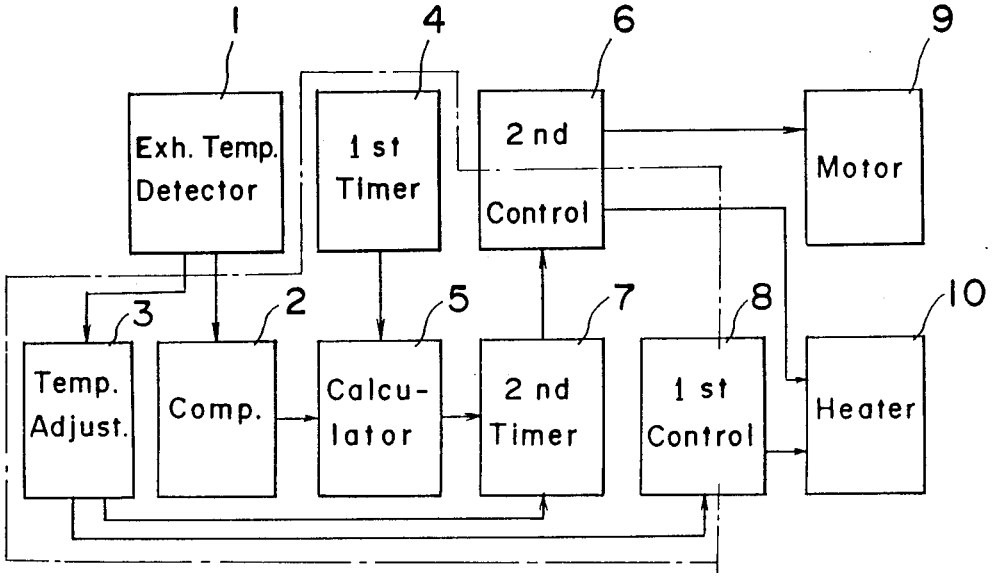
FIG. 2 is a circuit block diagram showng a control system for the dryer according to the present invention.

The clothes dryer schematically illustrated in FIG. 1 employs such a control system as shown in FIG. 2. The control system comprises an exhaust temperature detecting means 1 including the thermistor 24 for detecting the exhaust temperature during the operation of the dryer, a comparing means 2 operable in response to an output fed from the detecting means 1, a temperature adjustment 3 operable in response to an output fed from the detecting means 1 and when the exhaust temperature has attained a pedetermined value, for example, 65° C., a first timer means 4 for counting the length of time elasped from the start of the operation of the dryer until the generation of a control signal from the comparing means 2, and a calculating means 5 for determining the length of time corresponding to the time counted by the first timer means 4. The length of time determined by the calculating means 5 represents a time required for the clothes 26 to be dried to a predetermined dryness with no fault.

The control system also comprises a second timer 7 for counting the length of time determined by the calculating means 5 and for generating a control signal at the time the counting has completed (i.e., after the passage of the time determined by the calculating means 5), it being however that during the generation of the control signal from the temperature adjustment 3, the second timer means 7 ceases its counting operation. The control system further comprises first and second control means 8 and 6. The first control means 8 is operable to interrupt the supply of an electric power to a heater 10 in response to an output fed from the temperature adjustment. In other words, the supply of the electric power to the heater 10 is effected before the exhaust temperature attains the predetermined value (65° C.), or a value lower than the predetermined value if the temperature adjustmemt is in operation. On the other hand, the second control means 6 is operable to interrupt the supply of an electric power to both the heater 10 and a motor 9 in response to an output fed from the second timer means, thereby to complete the operation of the dryer. It is to be noted that a circuit portion encircled by the chain-lined block in FIG. 2 is processed by a microcomputer.

Figure 3A:
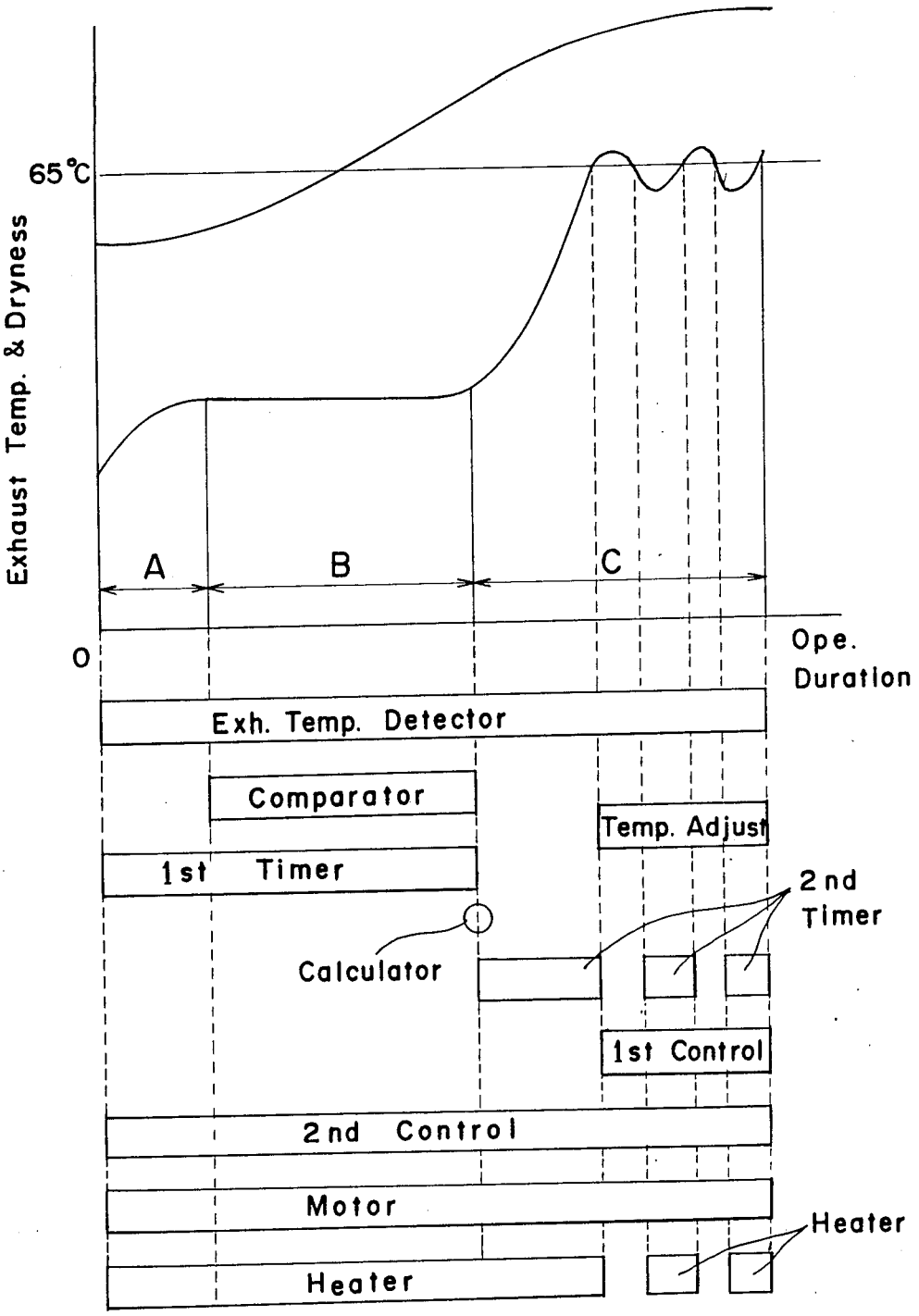
FIGS. 3(*a*) and 3(*b*) are graphs showings a characteristic relationship between the operating duration, during which the control system is operated, and the exhaust temperature in different situations, respectively, and also showing the operation of various component parts.
Figure 3B:
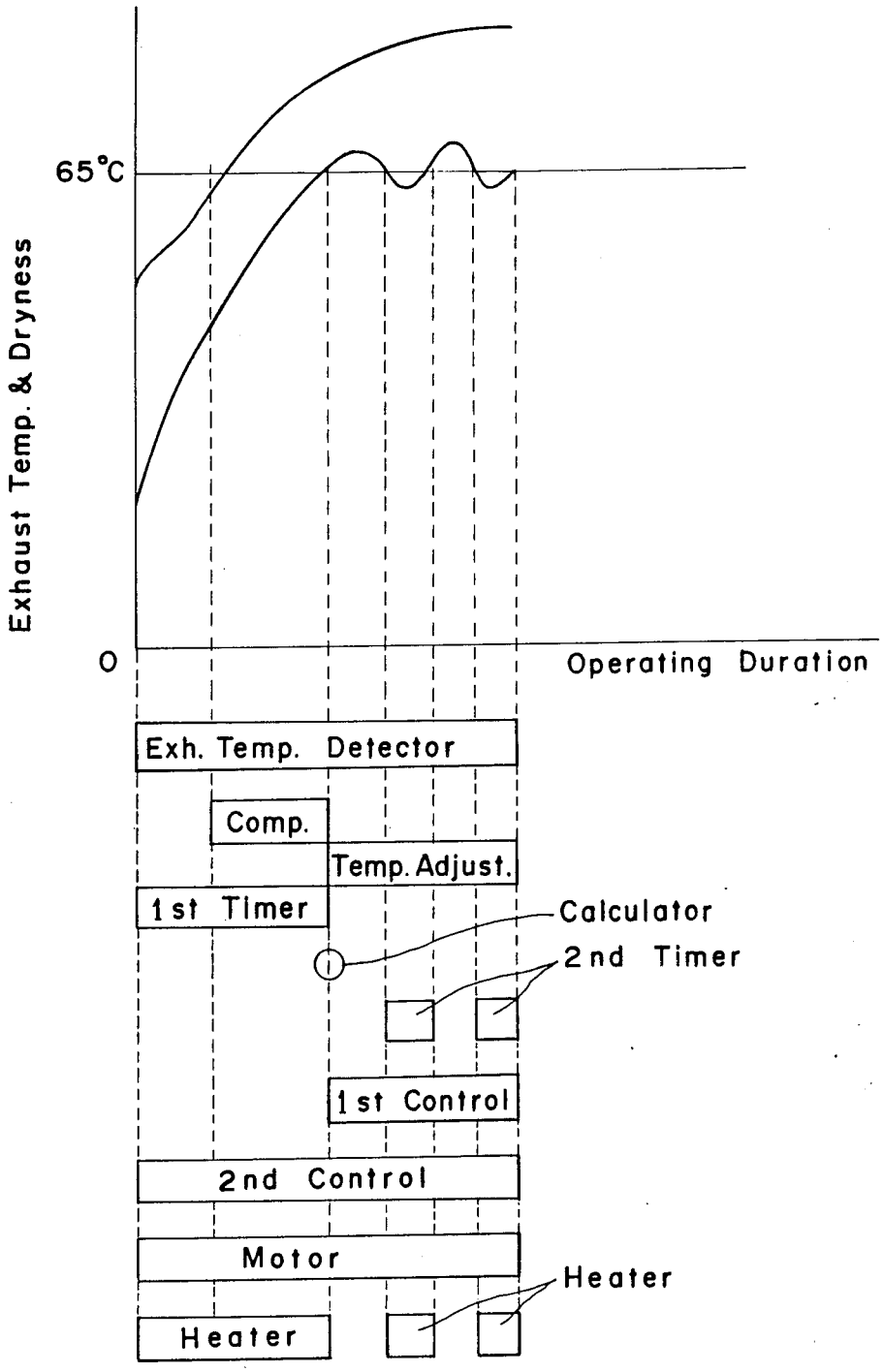

The operation of the control system of the above described circuit construction will now be described. FIG. 3 illustrates the relationship between the exhaust temperature and the dryness, which is exhibited when wet clothes 26 were dried within the drum 20 of the dryer. In FIG. 3(*a*), reference character A represents a preheating period during which heat produced is utilized to elevate the temperature of various portions of the dryer as well as that of the clothes. Accordingly, during this preheating period, the heat does not substantially participate in drying of the clothes, and only the exhaust temperature increases rapidly. This preheating period A is followed by a constant rate drying period B during which the heat produced is substantially totally used to dry the clothes with the dryness of the clothes consequently increasing linearly while the exhaust temperature remains substantially constant. The period B is in turn followed by a falling rate drying period C during which a substantially total quantity of moisture contained in the clothes is vaporized and, although the rate of increase of the dryness is slackened, the exhaust temperature increases abruptly.

When the quantity of the clothes put into the drum 20 of dryer for drying is very small, a similar relationship such as shown in FIG. 3(*b*) results in, wherein no clear distinction among the various drying periods such as shown by A, B, and C in FIG. 3(*a*) is apparent. In any event, respective periods during which the circuit components of the control system shown in FIG. 2 are operated are indicated in each of FIGS. 3(*a*) and 3(*b*).

The relationship between the operating duration of the dryer and the exhaust temperature will be hereinafter discussed.

Subsequent to the start of operation of the dryer, an electric power is supplied to both the heater 10 and the motor 9 with the exhaust temperature gradually increased incidentally. However, the change in exhaust temperature varies depending on the quantity of the clothes being dried as shown by D1, D2 and D3 in FIG. 4. More specifically, where the quantity of the clothes is small, the change in exhaust temperature follows the curve D1; where it is medium, it follows the curve D2; and where it is great, it follows the curve D3.

Figure 5:
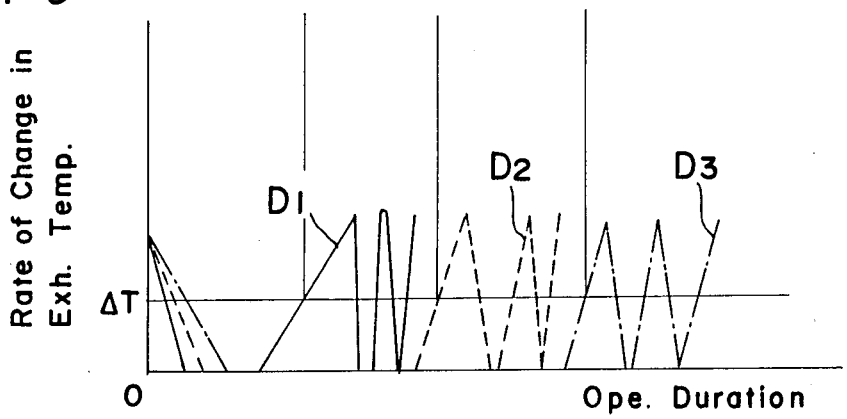
FIG. 5 is a graph showing a characteristic relationship between the operating duration of the control system and the rate of change in exhaust temperature.

The exhaust temperature detecting means 1 then detects the exhaust temperature and generates an output signal to the comparing means 2, which, in reference to the exhaust temperature, calculates the rate of change in exhaust temperature. The rate of change in exhaust temperature varies with the amount of the clothes being dried as shown in FIG. 5 wherein respective curves D1, D2 and D3 apply where it is small, medium and great. The comparing means 2 generates a control signal to the calculating means 5 when the rate of change in exhaust temperature is higher than a predetermined value $\Delta T$. However, since the exhaust temperature rapidly increases during the preheating period, the rate of change in exhaust temperature readily becomes higher than the predetermined value $\Delta T$. Therefore, for a predetermined time subsequent to the start of operation, the comparing means 2 is held inoperative.

Figure 4:
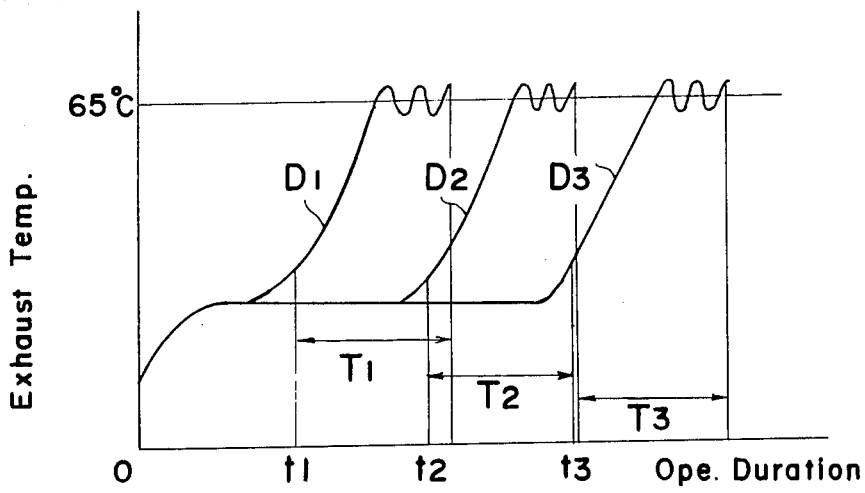
FIG. 4 is a graph showing a characteristic relationship between the operating duration of the control system and the exhaust temperature.
Figure 6:
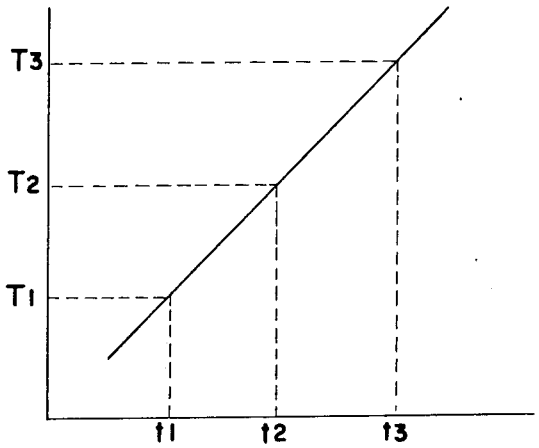
FIG. 6 is a graph showing a characteristic relationship between the time required for the rate of change of the exhaust temperature to attain a predetermined value $\Delta T$ and the time during which the heater is energized subsequent to the time at which the rate of change of the exhaust temperature has attained the predetermined value $\Delta T$ until the dryness attains a predetermined value.

The first timer means 4 has started its counting operation simultaneously with the start of operation of the dryer and counts the time elapsed until the comparing means 2 generates the control signal. The time counted by the first timer means 4 is shown in FIG. 4 by t3, t2 and t1 in the case where the quantity of the clothes being dried is great, medium and small, respectively. In FIG. 4, reference characters T1, T2 and T3 represent respective periods during which the heater 10 energized at respective times t1, t2 and t3 is kept energized until the dryness of the clothes attains a predetermined value (for example, 100%) in the case where the quantity of the clothes is small, medium and great, respectively. The time elapsed during each of the periods T1, T2 and T3 has such a relationship as shown in FIG. 6 and expressed by the following formula:

$$T=At+B \quad (1)$$

wherein T represents a dealy time counted between the time t to the time at which the dryness attains the pedetermined value, t represents the time during which the dryer is operated up until the rate of change in exhaust temperature attains the predetermined value ΔT, and A and B represent respective constants.

The calculating means 5 calculate the output from the first timer means 4 according to the above equation (1) to eventually determine each of the delay times T1, T2 and T3 depending on the quantity of the clothes actually put into the drum 20.

Figure 7:
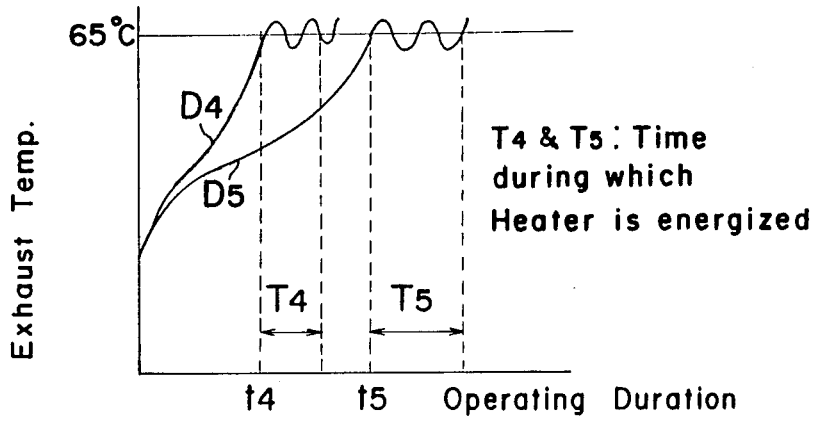
FIG. 7 is a graph showing a characteristic relationship between the operating duration of the control system and the exhaust temperature.
Figure 8:
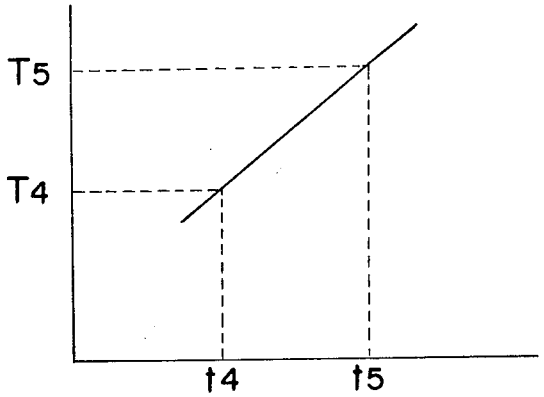
FIG. 8 is a graph showing a characteristic relationship between the time required for the exhaust temperature to attain a predetermined value Ta and the time during which the heater is energized subsequent to the time at which the exhaust temperature has attained the predetermined value Ta and until the dryness attains a predetermined value.
Figure 9:
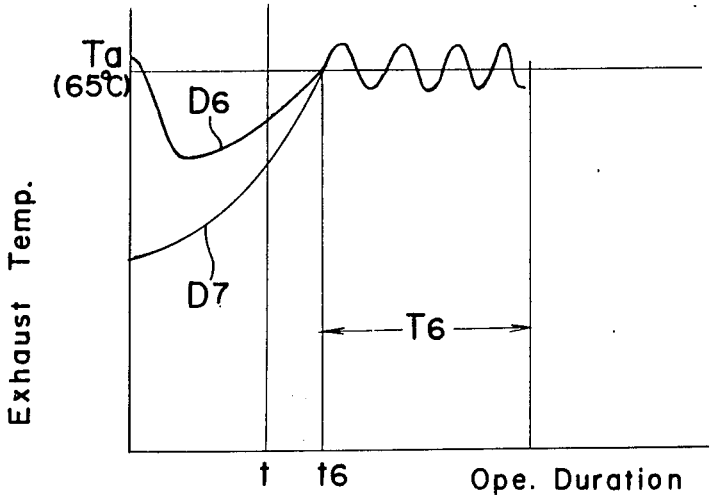
FIG. 9 is a graph showng a characteristic relationship between the operating duration of the control system and the exhaust temperature.

The temperature adjustment 3 is operable to compare the output from the exhaust temperature detecting means 1 with the predetermined temperature (65° C.), and to generate a control signal to the first control means 8 and the second timer means 7 only when the exhaust temperature has attained a a value higher than the predetermined temperature. The first control means 8 is operable to interrupt the supply of an electric power to the heater 10 so long as the temperature adjustment 3 generates its output signal, but to initiate the electric power supply to the heater 10 when the temperature adjustment is brought into operation with the exhaust temperature consequently lowered. This alternate switching off and on of the electric power supply to the heater continues until the drying operations terminates. The second timer means 7 is operable to count the length of time determined by the calculating means 5, it being, however, that during a period in which the temperature adjustment 3 keeps generating an output signal, that is, so long as no electric power supply is effected to the heater 10, the second timer means 7 ceases its counting operation. Accordingly, the second timer means 7 performs its counting operation only when the electric power supply to the heater 10 is in progress and generates a control signal to the second control means 6 when the counting operation completes, that is, upon the expiration of the time determined by the calculating means 5. In response to the output signal fed from the second timer means 7, the second control means 6 is operated to interrupt the electric power supply to both the heater 10 and the motor 9, with the dryer consequently terminating the drying operation. At this time, the clothes 26 within the drum 20 have been dried to the predetermined dryness.

Where the quantity of the clothes to be dried is relatively small, the exhaust temperature varies in a manner as shown in FIG. 7 wherein curves D4 and D5 represent the case where the quantity of the clothes is extremely small and the case where it is small, respectively. In these cases, the respective times required for the dryness to attain the predetermined value, i.e., 100%, are shown by $t_4$ and $t_5$. The rate of change in exhaust temperature does not vary in the way as shown in FIG. 5. However, since as shown in FIG. 8 the time required for the exhaust temperature to attain the predetermined value Ta (65° C.) has a linear relationship with the time $T_4$ or $T_5$ during which the heater 10 is energized subsequent to the attainment of the exhaust temperature to the predetermined value Ta until the dryness attains the predetermined value, the comparing means 2 after having compared the output from the detecting means 1 with the predetermined temperature can generate the control signal at the time the output from the detecting means 1 indicates the temperature higher than the predetermined value.

Where the dryer is utilized in such a way that while the clothes are being dried, an additional quantity of clothes is put into the drum 20 while the machine is interrupted for that moment, the exhaust temperature follows such a curve D6 as shown in FIG. 9 because it has already been high. Referring to the curve D6, the exhaust temperature may have attained the predetermined value Ta at the time the drying operation is restarted. Unless care is taken, the control system will erroneously recognize that the exhaust temperature has exceeded the predetermined value Ta subsequent to the additional charge of the clothes even though it is attributable to the previous drying of the clothes, and will prematurely terminate the drying operation. In order to eliminate this possibility, the comparing means 2 is so designed as to be disabled for a predetermined time t subsequent to the start of operation of the dryer, ensuring that even if the quantity of the clothes is relatively small, they can be dried in the predetermined dryness.

Figure 10:
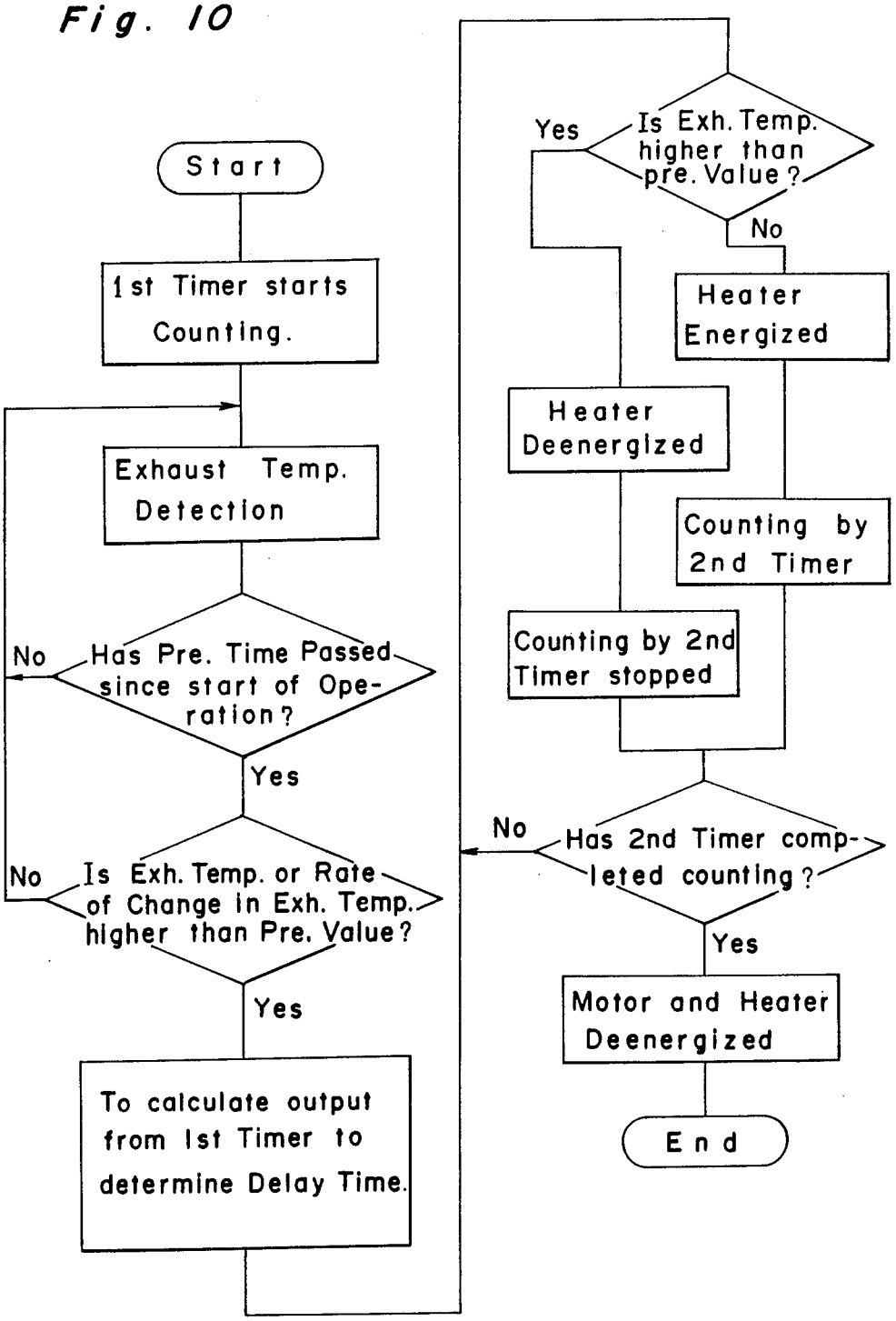
FIG. 10 is a flowchart showing the sequence of operation of the control system.

The flow of the process described hereinbefore is shown in the flowchart of FIG. 10.

Referring to FIG. 10, simultaneously with the start of operation of the dryer with both the heater 10 and the motor 9 energized, the first timer means 4 starts its counting operation. At the same time, the detecting means 1 keeps detecting the exhaust temperature. After the passage of a predetermined time subsequent to the start of operation, the comparing means 4 determines if the exhaust temperature or the rate of change in exhaust temperature is higher than the predetermined value. If it is higher than the predetermined value, the calculating means 5 calculates the output fed from the first timer means 4 to determine the delay time, or otherwise the process flow is repeated until the exhaust temperature or the rate of change in exhaust temperature becomes higher than the predetermined value.

When the exhaust temperature subsequently attains a value higher than the predetermined temperature, the temperature adjustment 3 generates the output with which the heater 10 is deenergized. If it is lower than the predetermined temperature, the heater 10 is energized. While the heater 10 is alternately switched on and off, that is, energized and deenergized, the second timer means 7 performs its counting operation only when the heater 10 is energized, and upon the expiration of the time determined by the calculating means 5, the second control means 6 causes both the motor 9 and the heater 10 to be deenergized, thereby completing the drying operation.

The determination of the quantity of the clothes put into the drum 20 is automatically carried out by a system wherein the quantity of the clothes is deemed normal unless the exhaust temperature attains the predetermined temperature (65° C.) within a predetermined period of time subsequent to the start of operation. In such case, the comparing means performs the comparison with respect to the rate of change in exhaust temperature and the calculating means determines a period of time during which the electric power supply to the heater is to be effected, according to an equation applicable where the quantity of the clothes is normal.

From the foregoing description of the present invention, it has now become clear that since after the passage of a predetermined time subsequent to the start of operation, the length of time during which the dryer is operated subsequently is determined in dependence on the time required for the exhaust temperature to attain the predetermined value or on the time required for the rate of change in exhaust temperature to attain the predetermined value, and since no counting is performed so long as the heater 10 is energized, the clothes are assuredly dried to the predetermined dryness even though the temperature control is occasionally performed, and therefore, there is no possibility of the clothes being excessively or insufficiently dried. It has also become clear that, even though the drying operation is interrupted for a moment and is subsequently restarted while the exhaust temperature remains high enough to readily exceed the predetermined value, the operating duration required for the dryer to operate subsequently until the clothes are dried will not be erroneously determined and, therefore, the clothes can advantageously be uniformly dried.

As compared with the prior art system utilizing the electrodes, the present invention is advantageous in that the satisfactory drying can be accomplished even though the quantity of the clothes is so small as they will not contact any one of the electrodes and in that no high voltage application is needed. Furthermore, as compared with the prior art system utilizing the combination of the electrodes with temperature sensitive element such as the thermistor, the present invention makes use of only the temperature sensitive element for achieving the intended purpose and is therefore simple in construction.

Although the present invention has been described in connection with the preferred embodiment thereof with reference to the accompanying drawings, it is to be noted that various changes and modifications are apparent to those skilled in the art without departing from the scope thereof as defined in the appended claims. Accordingly, unless they depart therefrom, they are to be understood as included within the scope of the present invention.

What is claimed is:

1. A control system for a clothes dryer which comprises:

an exhaust temperature detectng means for detecting the temperature of hot air vented from the dryer;

a comparing means for outputting a signal when either the exhaust temperature represented by an output from the detecting means or the rate of change in exhaust temperature attains a value higher than a predetermined value;

a first timer means for counting the time elapsed from the start of operation up until the generation of the signal from the comparing means;

a calculating means for determining the length of time from a time when an electric power is initially supplied to a heater until such time that clothes are dried to a predetermined dryness, in correspondence to the time counted by the first timer means;

a temperature adjusting means capable of generating, when the exhaust temperature is higher than the predetermined value, an output signal necessary to cause a first control means to interrupt the supply of the electric power to the heater;

a second timer means for generating an output upon the termination of the length of time determined by the calculating means, said second timer means ceasing a counting operation during a period in which the temperature adjusting means generates said output signal which interrupts the supply of electric power to the heater; and a second control means operable in response to the output from the second timer means for deenergizing both the the heater and a motor used to drive a drum for accommodating the clothes to be dried.

2. A system as claimed in claim 1, wherein the comparing means compares the exhaust temperature with the predetermined temperature where the quantity of clothes being dried is small.

3. A system as claimed in claim 1, wherein the comparing means compares the rate of change in exhaust temperature with the predetermined rate where the quantity of clothes being dried is normal.

4. A system as claimed in claim 1, wherein the comparing means is disabled for a predetermined time subsequent to the start of operation.

5. A system as claimed in claim 1, wherein the comparing means determines that the quantity of clothes being dried is normal, unless the exhaust temperature attains the predetermined value within a predetermined time, and starts comparing the rate of change in exhaust temperature.

6. A system as claimed in claim 2, wherein the calculating means calculates the time T during which the supply of the electric power to the heater is effected for drying clothes to a predetermined dryness subsequent to the time t counted by the first timer means, according to the following equation:

$$T=At+B$$

wherein A and B represent constants.

7. A system as claimed in claim 3, wherein the calculating means calculates the time T during which the supply of the electric power to the heater is effected for drying clothes to a predetermined dryness subsequent to the time t counted by the first timer means, according to the following equation:

$$T=At+B$$

wherein A and B represent constants.

* * * * *